US008029273B2

(12) United States Patent
Paschereit et al.

(10) Patent No.: US 8,029,273 B2
(45) Date of Patent: Oct. 4, 2011

(54) BURNER

(75) Inventors: Christian Oliver Paschereit, Berlin (DE); Bruno Schuermans, Basel (CH)

(73) Assignee: Alstom Technology Ltd, Baden (CH)

( * ) Notice: Subject to any disclaimer, the term of this patent is extended or adjusted under 35 U.S.C. 154(b) by 151 days.

(21) Appl. No.: 11/540,636

(22) Filed: Oct. 2, 2006
(Under 37 CFR 1.47)

(65) Prior Publication Data

US 2007/0128564 A1 Jun. 7, 2007

Related U.S. Application Data

(63) Continuation of application No. PCT/EP2005/051360, filed on Mar. 23, 2005.

(30) Foreign Application Priority Data

Mar. 31, 2004 (CH) ..... 0555/04

(51) Int. Cl.
*F23D 17/00* (2006.01)
*F23D 11/40* (2006.01)

(52) U.S. Cl. ..... 431/350; 431/9; 431/114

(58) Field of Classification Search ..... 431/9, 350, 431/114
See application file for complete search history.

(56) References Cited

U.S. PATENT DOCUMENTS 2,788,719 A * 4/1957 Bennett ..... 162/339
3,299,632 A * 1/1967 Coplin et al. ..... 60/746
3,763,650 A * 10/1973 Hussey et al. ..... 60/39.463
3,887,326 A * 6/1975 Townley ..... 432/14
3,989,444 A * 11/1976 Staudinger ..... 431/181
5,310,337 A * 5/1994 Lifshits et al. ..... 431/174
5,373,694 A * 12/1994 Clark ..... 60/804
5,417,564 A * 5/1995 Briggs ..... 431/179
5,482,457 A * 1/1996 Aigner et al. ..... 431/351
5,901,549 A * 5/1999 Mandai et al. ..... 60/776
5,983,643 A * 11/1999 Kiesow ..... 60/746
6,098,406 A * 8/2000 Bolis et al. ..... 60/737
6,176,087 B1 * 1/2001 Snyder et al. ..... 60/737
6,216,466 B1 * 4/2001 Alkabie ..... 60/746
6,336,806 B1 * 1/2002 Paschereit et al. ..... 431/1
6,558,154 B2 * 5/2003 Eroglu et al. ..... 431/8
6,599,121 B2 * 7/2003 Gutmark et al. ..... 431/182
6,676,048 B1 * 1/2004 Tiemann ..... 239/601
6,769,903 B2 * 8/2004 Eroglu et al. ..... 431/8
6,790,031 B2 * 9/2004 Berg et al. ..... 431/9
6,832,481 B2 * 12/2004 Koenig et al. ..... 60/737
7,137,809 B2 * 11/2006 Bueche et al. ..... 431/12
7,198,483 B2 * 4/2007 Bueche et al. ..... 431/12
2002/0177093 A1 * 11/2002 Paschereit et al. ..... 431/350
2003/0093997 A1 * 5/2003 Stalder et al. ..... 60/737
2005/0037305 A1 * 2/2005 Moriya et al. ..... 431/284

FOREIGN PATENT DOCUMENTS

DE 10029607 A1 * 12/2001
(Continued)

*Primary Examiner* — Carl Price
(74) *Attorney, Agent, or Firm* — Buchanan Ingersoll & Rooney PC

(57) ABSTRACT

A burner is disclosed which includes a vortex generator for a combustion air stream, means for the admission of fuel into the combustion air stream and air inlet ducts, the combustion air stream enters a vortex chamber of the vortex generator via air inlet ducts. The fuel is injected into the combustion air asymmetrically via the injection means.

3 Claims, 6 Drawing Sheets

FOREIGN PATENT DOCUMENTS

| | | | | |
|---|---|---|---|---|
| DE | 100 56 124 | A1 | | 5/2002 |
| DE | 100 64 893 | A1 | | 11/2002 |
| DE | 10160907 | A1 | * | 8/2003 |
| EP | 0 321 809 | | * | 6/1989 |
| EP | 870 989 | | * | 10/1998 |
| EP | 881431 | A2 | * | 12/1998 |
| EP | 0 918 152 | A1 | | 5/1999 |
| EP | 1205653 | A1 | * | 5/2002 |
| EP | 1235033 | A2 | * | 8/2002 |
| GB | 2 324 147 | | * | 10/1998 |
| JP | 2002115814 | | * | 4/2002 |
| JP | 2002317910 | | * | 10/2002 |
| WO | WO 02052201 | A1 | * | 7/2002 |
| WO | WO 02/061335 | A1 | | 8/2002 |
| WO | WO 02061335 | A1 | * | 8/2002 |
| WO | WO 02061337 | A1 | * | 8/2002 |

* cited by examiner

BURNER

RELATED APPLICATIONS

This application is based on and claims priority under 35 U.S.C. §119 to Swiss Application No. 00555/04, filed Mar. 31, 2004 and is a continuation application under 35 U.S.C. §120 of International Application No. PCT/EP2005/051360, filed Mar. 23, 2005 designating the U.S., the entire contents of both of which are hereby incorporated by reference.

BACKGROUND

The fluidic stability of a burner affects the occurrence of thermo-acoustic oscillations. Fluidic instability waves occurring at the burner can result in the formation of vortices or "coherent structures" that can influence the combustion process and lead to periodic releases of heat with the associated fluctuations in pressure. These high-amplitude fluctuations in pressure can result in a limitation of the operating range and can increase the emissions associated with the combustion. These problems occur particularly in combustion systems with low acoustic damping as often represented by modern gas turbines. Particularly in the lean combustion range there can be a periodic loss of flame stability that also results in pulsations.

Coherent structures play a crucial role in mixing processes between air and fuel. The spatial and temporal dynamism of these structures influences the combustion and the release of heat. A process is known from EP 0 918 152 A1 in which means for acoustic excitation of the working gas were arranged in the vicinity of the burner to counter the occurrence of coherent structures. This process provided for the shear layer formed in the area of the burner to be excited in order to require as little excitation energy as possible. The momentary acoustic excitation of the shear layer was mode locked with a signal measured in the combustion system in order to determine the excitation energy to be input and its frequency. This process requires, however, extensive means for controlling the thermo-acoustic oscillations.

A method is known from DE 100 56 124 A1 in which the flame position is influenced by means of a graduated injection of the fuel and hence the influence of fluidic instabilities and also time delay effects is reduced. For this, pickups to measure the pulsations and emissions of the combustion and regulating devices to control the graduated injections are used.

The adaption of the mixing profile in the burner can also have a direct influence on the pulsations and emissions. DE 100 64 893 A1 discloses a burner with a graduated injection in which the fuel outlet orifices are divided into at least three groups and the fuel mass flow of the groups can be axially symmetrically controlled independently of one another via valves. Opposed nozzles are thereby grouped together and not controlled independently of one another.

The essentially random variation of the mixing profile allows flame form and flame position to be changed. This enables the influence of fluidic instabilities and also time delay effects to be reduced. The occurrence of fluctuations in the heat release and hence the thermo-acoustic oscillation are reduced as a result.

SUMMARY

Exemplary emboidments can suppress thermo-acoustic oscillations even more effectively on a burner. Fuel can be injected into the combustion air asymmetrically via an injection means.

The advantages of the invention are to be seen inter alia in that pulsations can be suppressed even more effectively by the asymmetric injection of fuel. The asymmetry relates here to the opposed pairs of injection orifices in the flow direction. The asymmetry can be effected statically in that no injection orifice is arranged in the area opposite an injection orifice. This can also be effected, however, by an individual control of the fuel supply to the essentially symmetrically arranged fuel injection orifices. Different volumes of fuel are then supplied to opposed fuel injection orifices by means of the control device and hence an asymmetric fuel profile is achieved in the vortex chamber of the vortex generator.

BRIEF DESCRIPTION OF THE DRAWING

Illustrative embodiments of the invention are explained in greater detail below by reference to the drawings. Identical elements in the different figures are provided with the same reference numbers. The flow direction of the media is indicated with arrows.

Only elements for the immediate understanding of exemplary embodiments of the invention are shown; the cross-sections are only a schematic, simplified representation of the burner.

DETAILED DESCRIPTION

Figure 1:
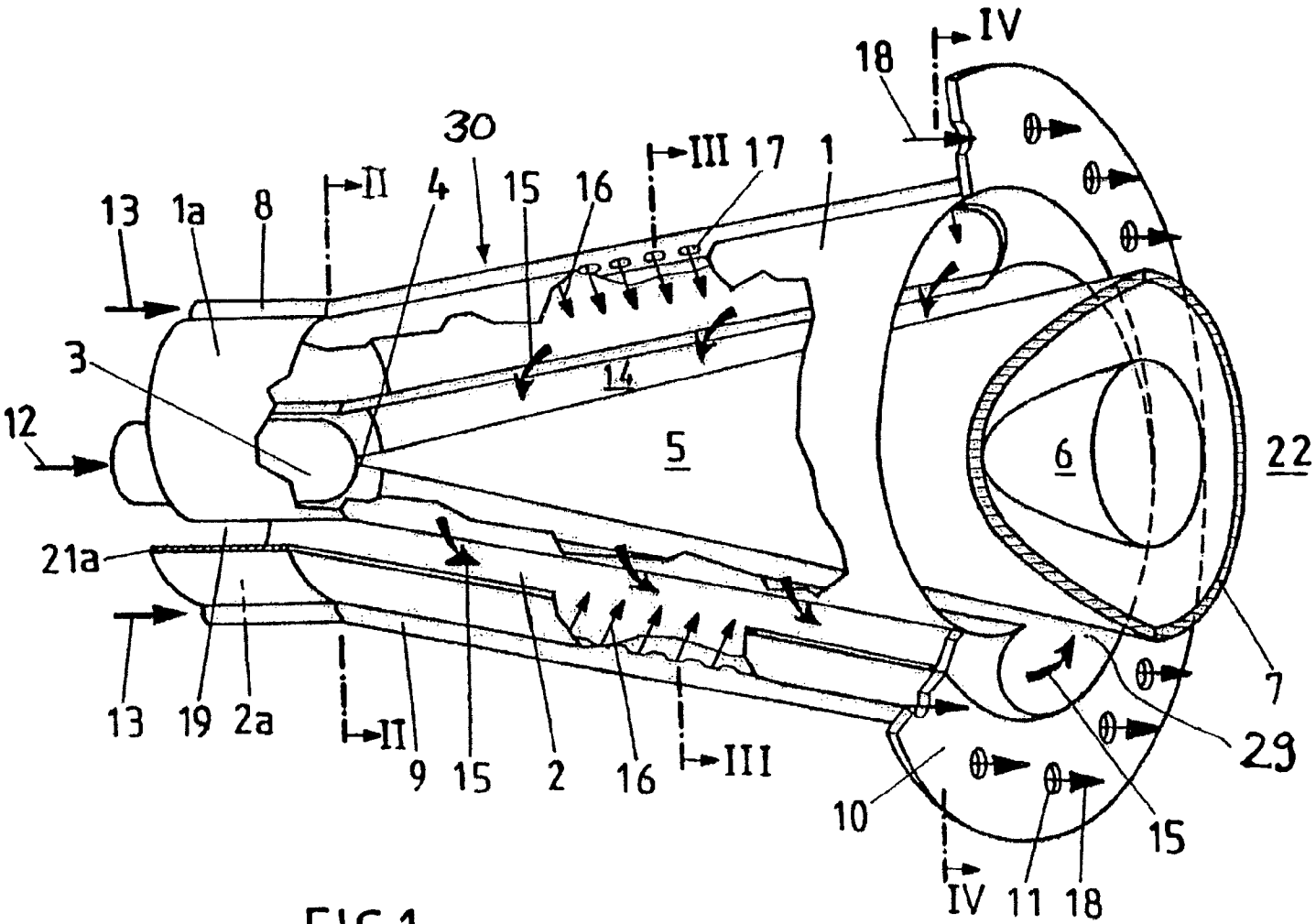
FIG. 1 shows a perspective representation of an exemplary burner, partially cut away.

The burner according to FIG. 1 includes (e.g., consists essentially of) a vortex generator 30 that essentially comprises (e.g., consists essentially of) two half hollow conical body segments 1, 2 arranged offset from one another. A burner of this type is referred to as a double-cone burner. The offsetting of the respective center lines 1*b*, 2*b* of the conical body segments 1, 2 from one another creates a tangential air inlet duct 19, 20 arranged in mirror image on each side (FIG. 2-4) through which the combustion air 15 flows into the inside of the burner, i.e. into the cone cavity 14 or "vortex chamber".

The two conical body segments 1, 2 each have a cylindrical starting section 1*a*, 2*a* that also run offset from one another by analogy with the conical body segments 1, 2, so that the tangential air inlet ducts 19, 20 are present from the outset. Arranged in this cylindrical starting section 1*a*, 2*a* is a nozzle 3 whose fuel injection nozzle 4 is aligned with the narrowest cross-section of the cone cavity 14 formed by the two conical body segments 1, 2.

The burner can, for example, be purely conical, in other words without the cylindrical starting sections 1*a*, 2*a*. The two conical body segments 1, 2 each have a fuel pipe 8, 9 that have orifices 17 through which the gaseous fuel 13 flows that is admixed with the combustion air 15 flowing through the tangential air inlet ducts 19, 20. The position of these fuel pipes 8, 9 is shown schematically in FIG. 2-4. The fuel pipes 8, 9 are located at the end of the tangential air inlet ducts 19, 20 so that mixing 16 of the gaseous fuel 13 with the incoming combustion air 15 takes place there.

On the combustion space side of the combustion chamber 22 the burner has a collar-like back plate 10 at the burner outlet 29 as an anchoring point for the conical body segments 1, 2, said back plate having a number of holes 11 through which dilution air or cooling air 18 can be admitted to the front part of the combustion space in the combustion chamber 22 or its wall, if necessary. The liquid fuel 12 flowing through the nozzle 3 is injected into the cone cavity 14 at an oblique angle in such a way that as homogeneous as possible a conical fuel spray is obtained in the burner outlet level, whereby strict attention has to be paid that the inner walls of the conical body segments 1, 2 are not wetted by the injected liquid fuel 12.

The fuel injection nozzle 4 can be an air-assisted nozzle or a mechanical atomizer. The conical liquid fuel profile 5 is surrounded by a tangentially entering, rotating combustion air stream 15. In the axial direction, the concentration of the liquid fuel 12 is continuously diluted by the admixed combustion air 15. If gaseous fuel 13 is combusted, the mixture formation with the combustion air 15 takes place directly at the end of the air inlet ducts 19, 20. With the injection of liquid fuel 12, the optimum homogeneous fuel concentration over the cross-section is achieved in the area of the vortex breakdown, in other words in the area of the backflow zone 6. Ignition takes place at the tip of the backflow zone 6. A stable flame front 7 can only be created at this point.

A flash-back of the flame into the inside of the burner, as is the latent case with premixing sections, can be fundamentally ruled out here. If the combustion air 15 is preheated, a natural evaporation of the liquid fuel 12 occurs before the point at the burner outlet is reached at which the ignition of the mixture can take place. The degree of evaporation is can be dependent on the size of the burner, the droplet size distribution and the temperature of the combustion air 15. Irrespective of whether the homogeneous droplet premixing is achieved by low-temperature combustion air 15 or additionally by an only partial or complete droplet evaporation by preheated combustion air 15, the nitrous oxide and carbon monoxide emissions are low if the air surplus is, for example, at least 60 percent.

The pollutant emission values are lowest in the case of complete evaporation before admission to the combustion zone. The same applies also to the near-stoichiometric operation if the surplus air is replaced with recirculating exhaust gas.

Close limits have to be observed in the design of the conical body segments 1, 2 with respect to cone angle and the width of the tangential air inlet ducts 19, 20 in order that the desired flow field of the air with its backflow zone 6 in the area of the burner opening is achieved for flame stabilization. It can be generally said that a reduction in the size of the air inlet ducts 19, 20 moves the backflow zone 6 further upstream, however with the result that the mixture would ignite earlier. It can be said here, nevertheless, that, once fixed geometrically, the backflow zone 6 has a stable position per se since the velocity of the vortex increases in the flow direction in the area of the cone shape of the burner.

Figure 2:
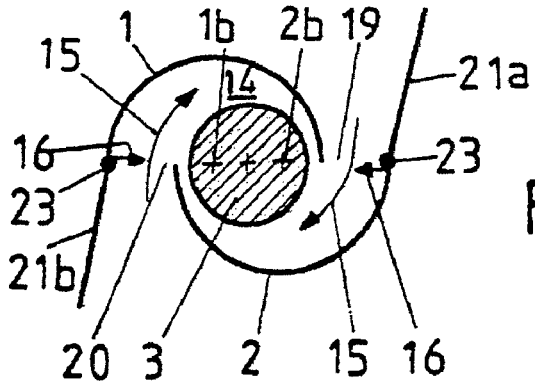
FIG. 2 shows a section through the plane II-II in FIG. 1.
Figure 3:
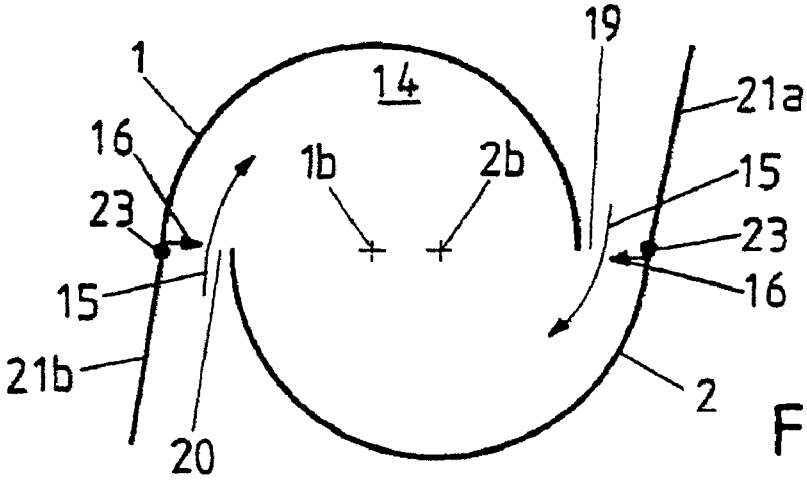
FIG. 3 shows a section through the plane III-III in FIG. 1.
Figure 4:
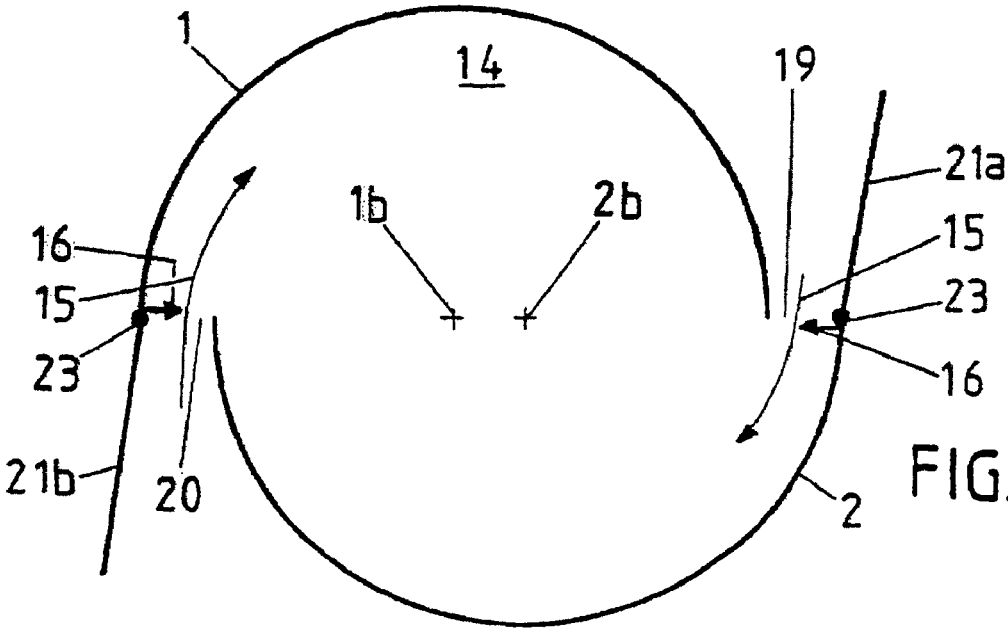
FIG. 4 shows a section through the plane IV-IV in FIG. 1.

FIG. 2-4 also show the position of the movable baffles 21*a*, 21*b*. They have flow initiation functions in that, with their different lengths, they extend the respective end of the conical body segments 1 and 2 in the incoming direction of the combustion air 15. The channeling of the combustion air in the cone cavity 14 can be optimized by opening or closing the movable baffles 21*a*, 21*b* about the pivot 23.

Figure 5:
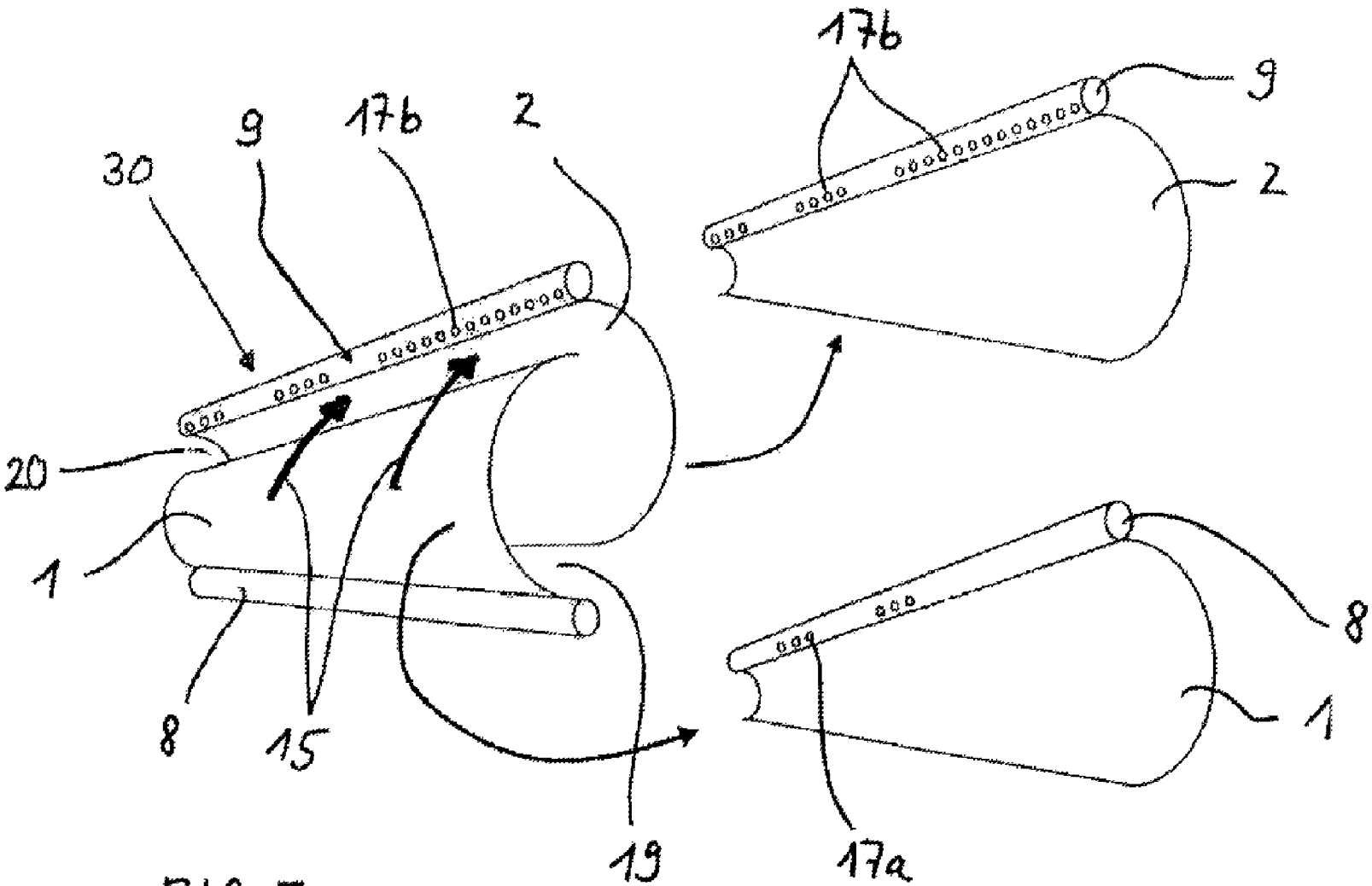
FIG. 5 shows a perspective representation of an exemplary burner with representation of the half-shells.

FIG. 5 shows the vortex generator 30 including (e.g., consisting of) the conical body segment 1 with the fuel pipe 8 and the conical body segment 2 with the fuel pipe 9 on the left-hand side in operating position and on the right-hand side in a position allowing the design of the two conical body segments to be compared. The orifices 17*a* of the fuel pipe 8 are arranged asymmetrically in relation to the orifices 17*b* of the fuel pipe 9. Fuel orifices 17*a* therefore lie opposite areas of the fuel pipe 9 in which no fuel orifices are arranged, and fuel orifices 17*b* thus lie opposite areas of the fuel pipe 8 in which no fuel orifices are located. As a result, an asymmetric fuel profile is created when the fuel is injected into the combustion air. This asymmetric arrangement of the fuel orifices 17*a* and 17*a* and the asymmetric fuel profile thereby created suppress pulsations. The type and extent of asymmetry created always has to be adapted to the particular case. Burner systems with few pulsations can have a low asymmetry of the fuel injection nozzles, while the asymmetry has to be increased for systems with a high level of pulsations.

The asymmetry is set using the method described in the following FIG. 7 in a test device. The setting can be carried out, for example, by trial-and-error or by means of an optimization algorithm. The asymmetry is set, e.g. by means of valves, such that the pulsations are minimized and the pollutant emission lies at an acceptable level.

Figure 6:
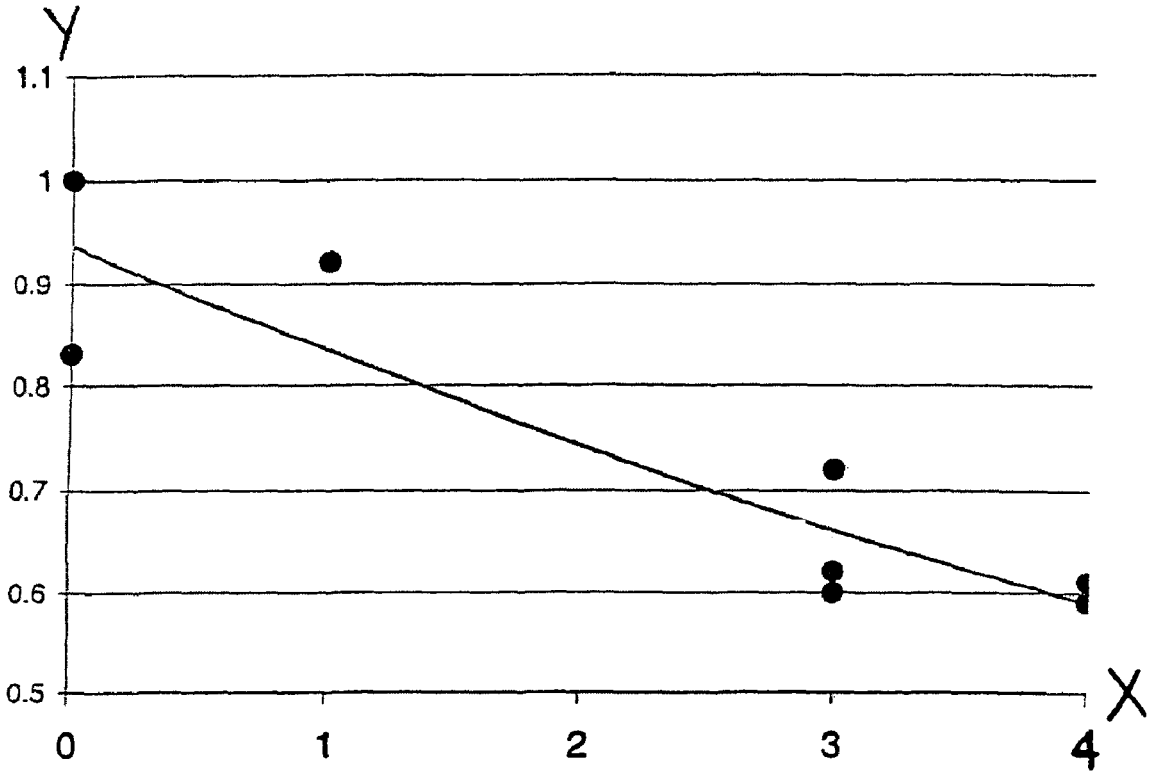
FIG. 6 shows a representation of the degree of asymmetry against pulsations.

In FIG. 6, the degree of asymmetry is plotted on the X axis and the value of the pulsations on the Y axis. This shows clearly that, with increasing asymmetry, the pulsations decrease and hence the pulsations and emissions can be reduced. The change in the fuel distribution, i.e. by means of an asymmetric fuel injection, thus enables the pulsations and emissions to be optimized.

Figure 7:
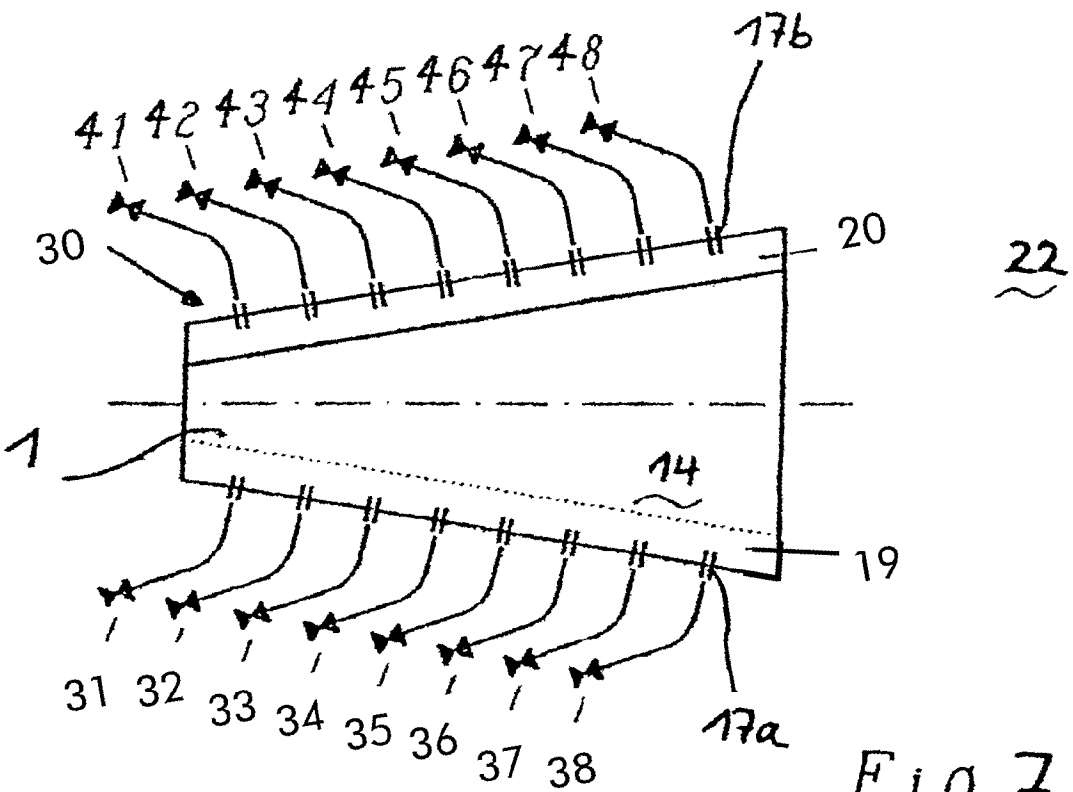
FIG. 7 shows a double-cone burner with individually controllable fuel nozzles.

FIG. 7 shows a further embodiment of the double-cone burner. The vortex chamber 14 is formed by the conical body segments 1 and 2. The combustion air flows via the air inlet ducts 19 and 20 into the vortex chamber 14. Arranged in the area of the air inlet ducts 19, 20 are fuel orifices 17*a* and 17*b* through which fuel can be injected into the combustion air. The resulting fuel-air mixture is transported into the combustion chamber and ignited. In this example, each air inlet duct 19, 20 of the double-cone burner has eight fuel injection orifices 17*a* and 17*b* that are individually supplied with fuel via a line. Arranged in each of these lines is a respective valve 31 to 38 or 41 to 48, each of which can be controlled independently of the others. In order to create an asymmetry, opposed fuel injection orifices 17*a* and 17*b* can be regulated by means of the valves 31 and 41, 32 and 42, 33 and 43, etc. in such a way that at least one of the eight opposed pairs of fuel orifices has a different fuel mass flow from that of the fuel orifice on the opposite side, so creating an asymmetric fuel supply.

The degree of the pulsations can be determined by means of sensors in the combustion chamber 22 and the degree of asymmetry can be adapted to the conditions by means of the fuel injection orifices 17*a* and 17*b* and the corresponding valve pairs 31 and 41, etc. This control of the asymmetry can naturally be combined with a graduated combustion according to the disclosure in DE 100 64 893 A1, the disclosure of which is hereby incorporated by reference in its entirety, in order to suppress harmful pulsations even more effectively.

The setting of the asymmetry for specific systems is performed on a test rig using electrically controllable valves. These are controlled by an open-loop and closed-loop control unit, such as a computer. This computer also processes the measured pulsations and pollutant emissions. The valves are set by means of an algorithm in such as way that the pulsations are minimized and the pollutant emissions remain below a defined level. The algorithm can thus also be adapted for the specific system.

Figure 8:
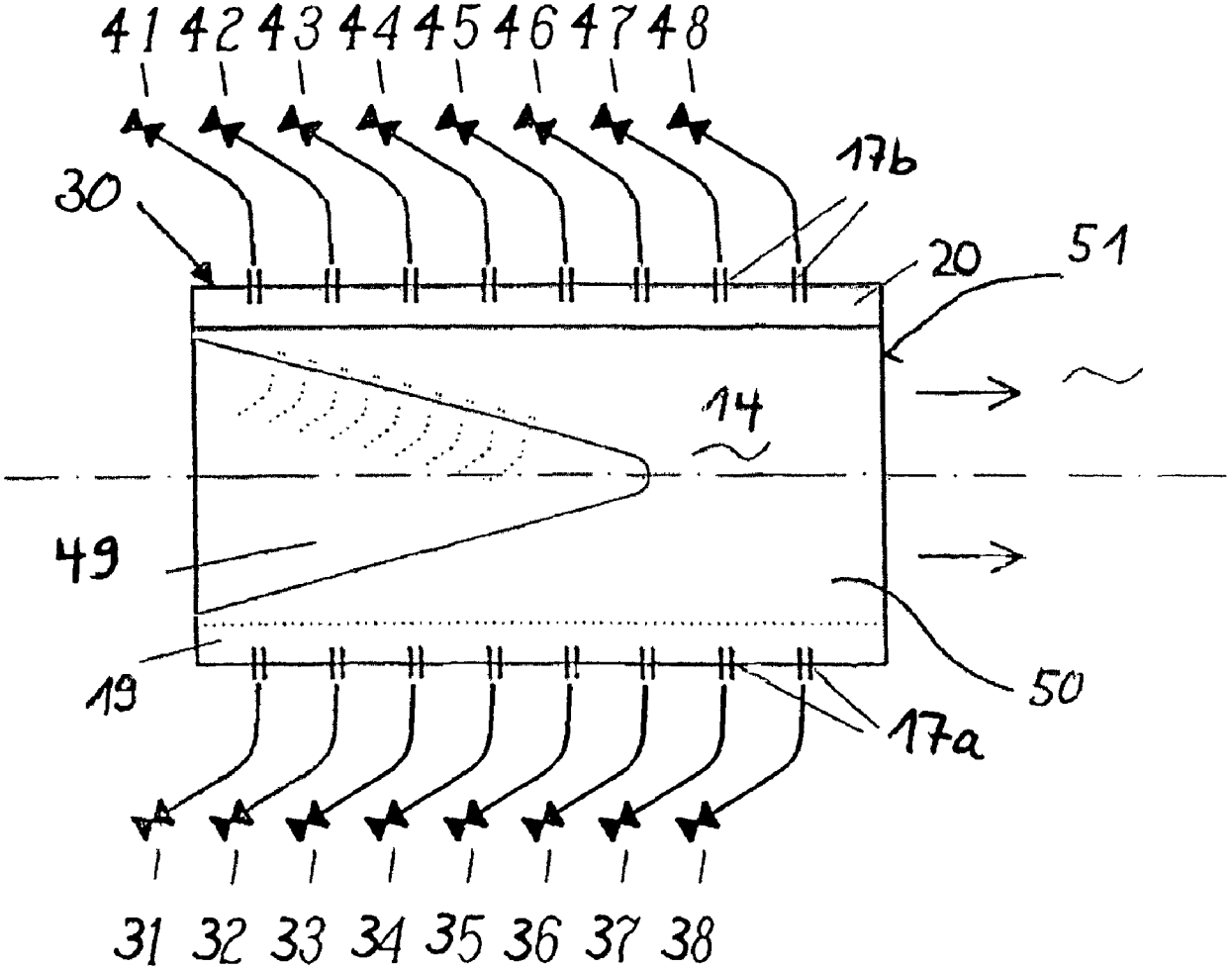
FIG. 8 shows a reversed double-cone burner with individually controllable fuel nozzles.

FIG. 8 shows another type of vortex-generating burner, a so-called reversed double-cone burner. The vortex generator is formed here by hollow cylindrical body segments 50, 51 that are arranged offset from one another and into the inside of which a conical body 49 tapering in the flow direction protrudes. Here again, the combustion air enters the vortex chamber 14 through the inlet ducts 19 and 20. The combustion air entering the vortex chamber is also set in rotation here by the conical body protruding into the inner space formed by the cylindrical body segments. As with the double-cone burner shown in FIG. 7, fuel orifices 17*a* and 17*b* are again arranged in the area of the air inlet ducts, through which orifices fuel is injected into the combustion air. The resulting fuel-air mixture is transported into the combustion chamber and ignited. Each air inlet duct 19, 20 of the reversed double-cone burner has eight fuel injection orifices 17*a* and 17*b* that are individually supplied with fuel via a line. Arranged in each of these lines is a valve 31 to 38 or 41 to 48, each of which valves can be controlled independently of the others. In order to create an asymmetry, opposed fuel injection orifices 17*a* and 17*b* are now regulated by means of the valves 31 and 41, 32 and 42, 33 and 43, etc. in such a way that at least one of the eight opposed pairs of fuel orifices has a different fuel mass flow from that of the fuel orifice on the opposite side, so creating an asymmetric fuel supply. The same principle as described under FIG. 7 applies to the control of the asymmetry.

The invention is naturally not limited to the illustrative embodiments shown and described. For example, the embodiment according to FIG. 5 can naturally also be combined with the embodiment according to FIG. 7 and/or that according to FIG. 8 in any combination or in any other suitable combination of features. The active control of the valves can thus be minimized. The number of fuel orifices and hence the number of valves can naturally be adapted as desired to meet the requirements. The burner can also have different forms from that shown in the illustrative embodiment and other burner types can also be used. The burner shown can be varied as desired with respect to the form and size of the tangential air inlets 19, 20.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 Conical body segment
1*a* Cylindrical starting section
1*b* Center line of conical body segment 1
2 Conical body segment
2*a* Cylindrical starting section
2*b* Center line of conical body segment 2
3 Nozzle
4 Fuel injection
5 Liquid fuel profile
6 Backflow zone
7 Flame front
8 Fuel pipe
9 Fuel pipe
10 Back plate
11 Holes
12 Liquid fuel
13 Gaseous fuel
14 Cone cavity, vortex chamber
15 Combustion air
16 Mixing
17 Orifice
17*a* Orifices in fuel pipe 8
17*b* Orifices in fuel pipe 9
18 Cooling air
19 Air inlet duct
20 Air inlet duct
21*a* Movable baffle
21*b* Movable baffle
22 Combustion chamber
23 Pivot
29 Burner outlet
30 Vortex generator
31-38 Valves of the fuel nozzles at the first gap
41-46 Valves of the fuel nozzles at the second gap
49 Conical body
50,51 Cylindrical body segment

The invention claimed is:

1. A burner comprising:

a vortex generator for a combustion air stream;

a plurality of air inlet ducts via which the combustion air stream enters a vortex chamber of the vortex generator, wherein fuel is injected into the combustion air stream at each of the plurality of air inlet ducts, and wherein the fuel is injected asymmetrically with respect to the combustion air stream; and a plurality of fuel pipes, each one of the plurality of fuel pipes being arranged to inject the fuel at a different one of the plurality of air inlet ducts and having a group of fuel injection orifices arranged in a pattern, wherein each of the fuel injection orifices of all of the groups of fuel injection orifices is arranged at an axial position with respect to a longitudinal axis of the burner, and wherein each of the axial positions is different from all other of the axial positions.

2. The burner as claimed in claim 1, wherein said plurality of air inlet ducts are arranged symmetrically with respect to the vortex generator.

3. The burner as claimed in claim 1, wherein the burner is a double-cone burner with a vortex generator having at least two hollow conical body segments positioned against one another that become wider in the flow direction and are offset from one another so that the combustion air stream flows through the air inlet ducts thus formed into the vortex chamber.

* * * * *